United States Patent [19]

Keller

[11] 4,365,125

[45] Dec. 21, 1982

[54] FLOW ACTUATING SWITCHING DEVICE

[75] Inventor: George D. Keller, Philadelphia, Pa.

[73] Assignee: Beta, B.V., The Hague, Netherlands

[21] Appl. No.: 360,203

[22] Filed: Mar. 22, 1982

Related U.S. Application Data

[63] Continuation of Ser. No. 146,139, May 2, 1980, abandoned.

[51] Int. Cl.[3] ..... H01H 35/38

[52] U.S. Cl. ..... 200/81.9 M; 200/82 E

[58] Field of Search ..... 200/81 R, 81.9 R, 81.9 M, 200/82 R, 82 E, 83 Q; 335/205-207; 340/606, 611; 73/745, 308, 313

[56] References Cited

U.S. PATENT DOCUMENTS

| | | | |
|---|---|---|---|
| 2,419,942 | 5/1947 | Brewer | 200/81.9 M |
| 2,927,176 | 3/1960 | Auld, Jr. | 200/81.9 M |
| 3,200,214 | 8/1965 | Aubert | 200/81.9 M |
| 3,273,091 | 9/1966 | Wales, Jr. | 335/207 |
| 3,297,843 | 1/1967 | Hoss | 200/81.9 M |
| 3,327,079 | 6/1967 | Widl | 200/81.9 M |
| 3,446,986 | 5/1969 | Cox | 200/81.9 M |
| 3,562,455 | 2/1971 | McQueen | 200/81.9 M |
| 3,766,779 | 10/1973 | Hoffman | 200/81.9 M |
| 4,081,635 | 3/1978 | Moore | 200/82 E |

*Primary Examiner*—G. P. Tolin

*Attorney, Agent, or Firm*—Charles H. Lindrooth

[57] ABSTRACT

A fluid actuated switching system is disclosed which comprises a fluid actuated poppet mounted in a fluid passageway for movement from a first position in the absence of fluid flow to a second position in response to a predetermined fluid flow. An elongated permanent magnet element is mounted on the poppet for movement along the axis of movement of the poppet. A second magnet element is positioned exteriorly of the fluid passageway adjacent the first magnet element. The two elongated magnet elements are polarized so that like poles are adjacent to one another and repel the two elements when the flow actuated poppet is in the first position and attract one another when the flow actuated poppet is in the second position, thereby moving the second magnet element with a snap action from one position to the other. The second magnet element actuates an electrical or pneumatic switch. As disclosed, the flow actuated poppet moves along an axis which is perpendicular to the axes of the inlet and outlet ports of its housing. The long axes of the magnetic elements parallel the axis of movement of the poppet member so that all moveable elements are oriented in the same plane without regard to the orientation of the inlet and outlet conduits.

5 Claims, 8 Drawing Figures

FLOW ACTUATING SWITCHING DEVICE

CROSS-REFERENCE TO RELATED APPLICATION

This application is a continuation of application Ser. No. 146,139 filed May, 2, 1980 (now abandoned).

FIELD OF THE INVENTION

This invention relates to flow actuating switching devices useful in the performance of indication and control functions and more particularly relates to actuating devices of the magnetic type wherein a magnetic element located within or in communication with the flow stream actuates a switch positioned externally of the flow stream.

BACKGROUND OF THE INVENTION

Devices located in a flow path for actuating an electrical switch in response to the flow of fluid in a conduit are well known. Many such actuating devices involve the use of a reciprocating poppet member which is unseated and moved to an open position in response to flow of fluid through the conduit. This poppet physically moves a permanent magnet or magnetic element into a position of interaction with a second magnetic element and this interaction is effective to cause movement of electrical switching means from a first to a second operating position. Examples of such switch actuating means are shown in U.S. Pat. Nos. 3,200,214, 3,297,843, 3,327,079, 3,446,986, 3,562,455, and 4,081,635.

SUMMARY AND OBJECTS OF THE INVENTION

The principal object of the present invention is the provision of magnetic actuating means for positively actuating and holding a fluid actuated switch in each of two conditions of operation.

A further object of the invention is the provision of fluid actuated switch means which is extremely simple in construction and in operation.

A still further object of the invention is an improvement in reliability and sensitivity in fluid actuated switch means.

Another objective of the invention is the provision of a flow actuated switch means which operates with equal response in any conduit orientation.

In summary, the above and other objectives of the invention are achieved by a pair of elongated permanent magnet elements which are mounted for axial movement in substantially parallel paths. The first of these permanent magnet elements is operatively connected with valve means or other element physically located within the fluid stream for movement in response to fluid flow. The second permanent magnet element is located externally of the fluid stream and is operatively connected to a switch for movement of the switch between first and second operating positions. In a first position of the two permanent magnet elements, the magnetic fields interact to effect repulsion of the second permanent magnet element to hold the switch in one operating position. In a second position of the first permanent magnet element, the fields again interact to effect attraction of the two magnets to move the second permanent magnet element to a position in which the switch is held in a second operating position.

The above as well as other objects and advantages of the invention will become clearly apparent from the following detailed description of an illustrative embodiment of the invention, illustrated in the accompanying drawings in which.

DETAILED DESCRIPTION OF THE ILLUSTRATIVE EMBODIMENT OF THE INVENTION

Figures 1, 2, 3, 4:
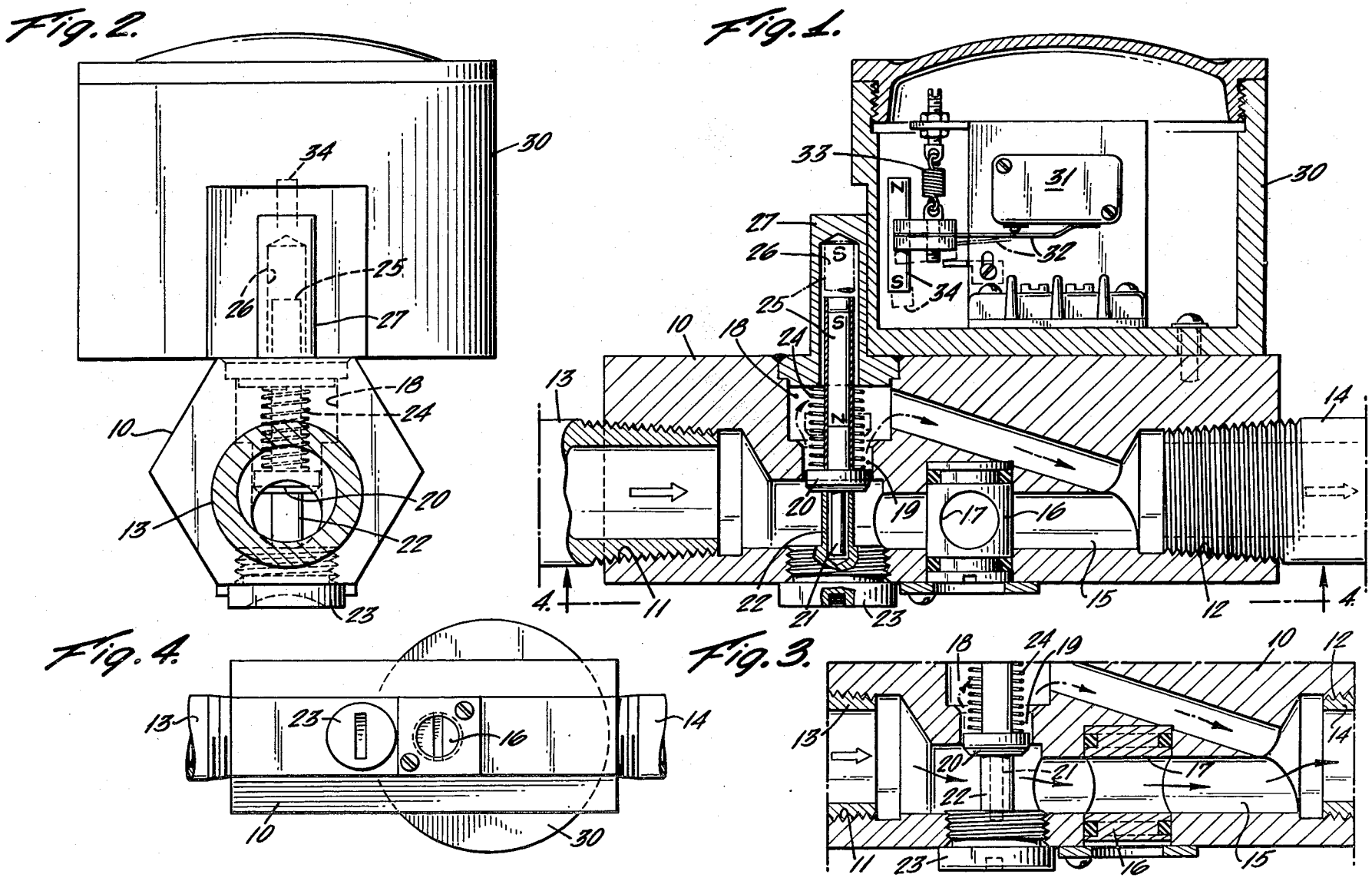
FIG. 1 is a sectional elevational view of a preferred embodiment of the invention as it is installed in a fluid flow conduit.
FIG. 2 is an end elevational view of the device shown in FIG. 1.
FIG. 3 is a detailed sectional view illustrating a portion of the device shown in FIG. 1, in which the flow actuated means of the invention are bypassed.
FIG. 4 is a bottom view, on a reduced scale, of the device shown in FIGS. 1–3.

Referring first to FIG. 1, the invention comprises a housing 10 having a pair of openings 11 and 12 into which conduit sections 13 and 14 are fitted. The housing openings and the ends of the conduit sections may be threaded or otherwise interconnected so that fluid tight seals are provided.

A first flow passage 15 extends through the housing from the threaded inlet 11 to the outlet 12. A valve 16 is located within this passage. In the position shown in FIG. 1 the valve is in the closed position blocking flow through the passage. The valve 16 is provided with an opening 17 and when the valve is rotated 90° about its vertical axis from the closed position to the position shown in FIG. 3, total fluid flow can be adjusted.

Located just upstream from the valve 16, there is provided a second flow passage 18 having a reduced diameter portion 19 in which a fluid actuated means such as poppet member 20 is located. The poppet member 20 is provided with a stem 21 which is guided within a tubular extension or projection 22 which extends upwardly from a threaded plug 23 which is threaded into the side wall of the housing in order to provide access to the poppet member 20 if desired.

Poppet member 20 is preferably spring urged to the position shown in FIG. 1 by means of a coil spring 24, although the coil spring may be unnecessary in certain installations where the poppet is vertically oriented and can return to the closed position by gravity. An elongated permanent magnet element 25 is mounted on top of the poppet member 20 for movement on its long axis upon movement of the poppet. The magnet element 25 moves within the confines of a cavity 26 which is defined by a small enclosure projecting from the side of housing 10.

With the valve 16 in the closed or no-flow position shown in FIG. 1, fluid entering the housing as indicated by directional arrow 26, lifts poppet member 20 upwardly as viewed in FIG. 1 against the biasing of spring 24. At a given flow condition governed by spring 24, and the flow permitted through the first flow passage as regulated by valve 16, the poppet and magnet 25 are shifted to the broken line position illustrated in FIG. 1.

A second housing 30 is bolted or otherwise secured to the housing 10. This housing contains an electrical or pneumatic type switch. In the illustrative embodiment a snap action electrical switch 31 is provided, having actuating arm 32 which moves contact elements not shown between first and second operating positions. Preferably a spring 33 holds the actuating arm in one of its two operating positions as can be seen in FIG. 1.

The end of actuating arm 32 carries a second, elongated permanent magnet element 34. The magnet element 34 is positioned for movement in a path which is substantially parallel to the path of movement of the magnet element 25.

Figure 5A:
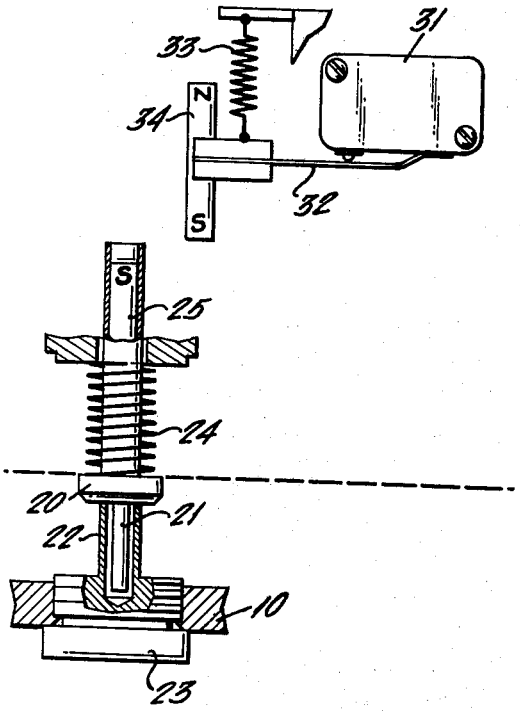
FIG. 5A is a schematic view showing permanent magnet elements used in the invention in a first condition of operation.
Figure 5B:
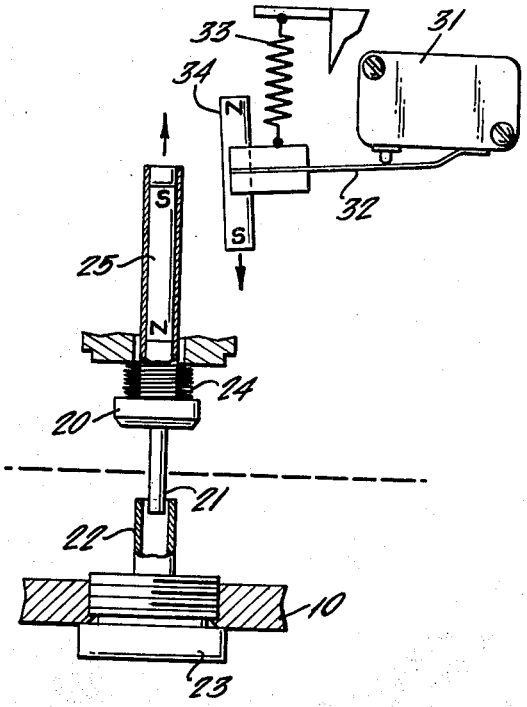
FIG. 5B is a schematic view showing permanent magnet elements used in the invention in a second condition of operation.

According to the invention, the elongated magnet elements 25 and 34 are located so that in a first condition of operaton, as illustrated in FIG. 1 and FIG. 5A, the fields generated by the permanent magnet elements hold the switch in one operating position. This is preferably accomplished by polarizing the elements with adjacent like poles of the two elements positioned to interact so that there is a repulsion of the two elements, urging the element 34 away from the element 25 so that the contact switch 31 is urged towards its first operating position. When the flow of fluid through conduit 13 is sufficient to effect a movement of poppet member 20 to the open position, shown in broken lines in FIG. 1 and in full line in FIG. 5B, the magnets 25 and 34 are moved relatively to one another so that the unlike poles are adjacent to one another effecting a strong attraction and a shifting of the magnet element 34 downwardly as viewed in FIG. 5B so that the switch contacts of switch 31 are shifted to the second operating position. So long as the fluid flow around the valve 20 holds the valve in the upper position illustrated in FIG. 5B, the switch is positively and continuously magnetically urged to the second operating position.

Figure 6:
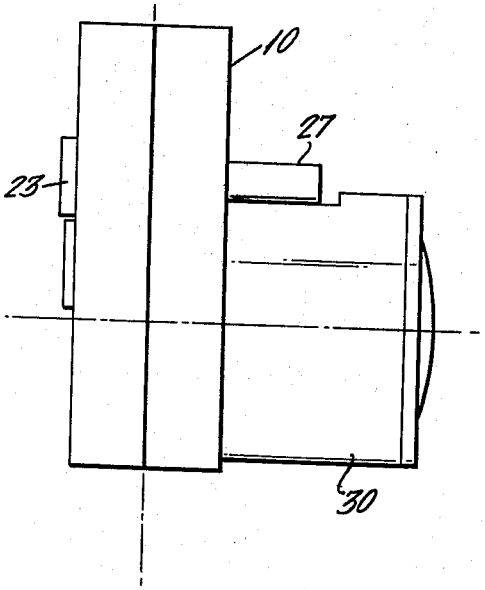
FIG. 6 is a schematic view showing the preferred position of installation of the device in a vertically extending conduit.
Figure 7:
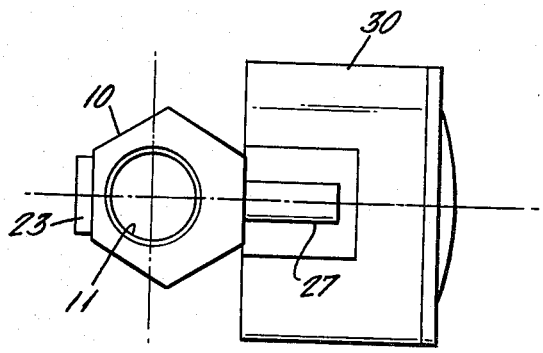
FIG. 7 is a schematic view showing the preferred position of installation of the device in a horizontally extending conduit.

Although FIGS. 1 through 5 illustrate an orientation of parts in which the two magnet elements are moved in vertical planes, it is to be understood that this orientation is for illustrative purposes only. It is preferred that the parts be oriented in the same plane whether the invention is installed in a horizontally extending conduit or in a vertically extending conduit so that the actuating response of the parts is always exactly the same. FIGS. 6 and 7 show respectively installation in a vertically oriented conduit and a horizontally extending conduit. In each instance, magnet elements 25 and 34 extend in the same direction.

Flow actuated switch means constructed in accordance with the invention are extremely sensitive and have proven to be quite reliable in operation. Reliability is achieved by the permanent magnet means including two permanent magnets polarized so that at each operating position the magnets urge the switch towards the intended operating position.

I claim:

1. A fluid actuated system for actuation of a switch, said system being responsive to flow of a fluid in a passageway, and comprising a housing through which said passageway extends, said passageway including inlet and outlet openings in opposed ends of said housing, said passageway including a portion which is substantially perpendicular to said inlet and outlet openings, a fluid actuated member mounted for movement along the perpendicularly extended portion of said passageway in response to fluid flow, a first elongated permanent magnet element moveable with said fluid actuated member, said permanent magnet element having poles displaced along the longitudinal axis thereof and being moveable by said fluid actuated member along said axis from a first position in the absence of fluid flow to a second position in response to a predetermined fluid flow, a second elongated permanent magnet element having poles displaced along the longitudinal axis thereof, means mounting the second elongated permanent element for movement along said second named longitudinal axis adjacent said first magnet element, said mounting means for the second magnet element limiting the movement of said second magnet element to a direction extending at least primarily along its longitudinal axis, the longitudinal axes of said first and second magnet elements being substantially parallel to each other, said magnet elements being polarized so that in a first position of the first element an end of one polarity on the first element is adjacent an end of the same polarity on the second element whereby the forces of magnetic repulsion bias the second element to one switch actuating position and in a second position of the first element the end of one polarity on the first element is intermediate the ends of the second element whereby the forces of magnetic attraction and repulsion bias the second element to a second switch actuating position.

2. Apparatus according to claim 1 wherein said first permanent magnet element is located interiorly of the passageway and said second permanent magnet element is located exteriorly of the passageway.

3. Apparatus according to claim 2 wherein said fluid actuated member is a poppet, means biasing said poppet to a position in which flow through the passage is restricted, said poppet being moveable by fluid flow to shift said first magnet element from the first to the second position and thereby effect movement of the second magnet element to the second switch actuating position.

4. A fluid actuated system for actuating a switch or the like, said system being responsive to flow of fluid in a passage and comprising a housing having inlet and outlet openings and a passageway through the housing for the circulation of fluid from the inlet to the outlet opening, a flow responsive poppet member in the housing, said poppet member being moveable in response to fluid flow along an axis which is perpendicular to the axes of said inlet and outlet openings, a first elongated permanent magnet element moveable with said poppet member; and first permanent magnet element having its long axis parallel to the axis of movement of said poppet member and having its poles displaced along its long axis, said first magnet element being moveable by said poppet member along said axis from a first position in the absence of fluid flow to a second position in response to a predetermined fluid flow, a second elongated permanent magnet element having poles displaced along the longitudinal axis thereof and means mounting said second elongated element for movement along said last named longitudinal axis adjacent said first magnet element, said mounting means for the second magnet element limiting the movement of said second magnet element to a direction extending at least primarily along its longitudinal axis, the longitudinal axes of said first and second magnet elements being substantially parallel to each other, said magnet elements being positioned relative to each other so that when the first magnet element is in the first position the elements are longitudinally spaced from one another with an end of one polarity on the first element facing an end of the same polarity on the other element, whereby the forces of magnetic repulsion bias the second element to one switch actuating position, and so that when the first magnet element is moved to the second position the said end on said first element is positioned intermediate the ends of the other element and relatively to the end of same polarity on the other element so that the forces of magnetic repulsion bias the second element to the other switch actuating position, and relative to the end of opposite polarity of said second element whereby the forces of magnetic attraction bias the second element to the other switch actuating position.

5. Apparatus according to claim 4 wherein said first permanent magnet element is located interiorly of the passageway and said second permanent magnet element is located exteriorly of the passageway.

* * * * *

UNITED STATES PATENT AND TRADEMARK OFFICE

CERTIFICATE OF CORRECTION

PATENT NO. : 4,365,125

DATED : December 21, 1982

INVENTOR(S) : George D. Keller

It is certified that error appears in the above—identified patent and that said Letters Patent is hereby corrected as shown below:

| | |
|---|---|
| Col. 2, line 64 | After "enclosure" insert --27--. |
| Col. 2, line 68 | After "arrow" delete "26". |
| Col. 3, line 21 | "operaton" should read --operation--. |
| Col. 4, line 13 | After "permanent" insert --magnet--. |
| Col. 4, line 51 | "and" should read --said--. |

Signed and Sealed this

*Thirteenth* Day of *December 1983*

[SEAL]

*Attest:*

GERALD J. MOSSINGHOFF

*Attesting Officer*

*Commissioner of Patents and Trademarks*